US010254068B2

(12) United States Patent
Piemme et al.

(10) Patent No.: US 10,254,068 B2
(45) Date of Patent: Apr. 9, 2019

(54) BAFFLES, SUPPRESSORS, AND POWDER FORMING METHODS

(71) Applicant: Praxis Powder Technology, Inc., Queensbury, NY (US)

(72) Inventors: Jobe Piemme, Queensbury, NY (US); Joseph A. Grohowski, Jr., Glen Falls, NY (US); Paul H. Sheffield, Queensbury, NY (US)

(73) Assignee: Praxis Powder Technology, Inc., Queensbury, NY (US)

( * ) Notice: Subject to any disclaimer, the term of this patent is extended or adjusted under 35 U.S.C. 154(b) by 0 days.

(21) Appl. No.: 15/372,018

(22) Filed: Dec. 7, 2016

(65) Prior Publication Data

US 2017/0160035 A1 Jun. 8, 2017

Related U.S. Application Data

(60) Provisional application No. 62/264,225, filed on Dec. 7, 2015.

(51) Int. Cl.
*F41A 21/30* (2006.01)
*C22C 14/00* (2006.01)

(52) U.S. Cl.
CPC ..... *F41A 21/30* (2013.01); *C22C 14/00* (2013.01)

(58) Field of Classification Search
CPC ..... F41A 21/23
USPC ..... 89/14.4
See application file for complete search history.

(56) References Cited

U.S. PATENT DOCUMENTS 3,713,362 A * 1/1973 Charron ..... F41A 21/30 89/14.4
4,606,886 A * 8/1986 Neal ..... C22C 14/00 148/407
5,017,311 A * 5/1991 Furusawa ..... B29C 45/568 264/328.1

(Continued)

OTHER PUBLICATIONS

Okabe et al; Deoxidation of Titanium Aluminide by Ca-Al under controlled Aluminum Activity; p. 583-590; Oct. 1992 (Year: 1992).*

(Continued)

*Primary Examiner* — Joshua E Freeman
(74) *Attorney, Agent, or Firm* — Charney IP Law LLC

(57) ABSTRACT

A method of forming a firearm suppressor baffle including preparing a titanium alloy powder system, forming of the powder system into a green shape, optionally green machining the green shape, sintering the green shape to create a firearm suppressor baffle formed from sintered material, where the firearm suppressor baffle has an elevated oxygen content of between 0.2 and 0.5 weight percent. The resultant sintered material may have a creep value of less than 1.5% at 50 hours at 450 C. Also, a method of forming a firearm suppressor baffle including preparing a titanium aluminide powder system, forming the titanium aluminide powder system into a green shape through one of compaction and powder metal injection molding, and sintering the green shape to create the firearm suppressor baffle. The titanium aluminide powder method may also include deoxygenating the firearm suppressor baffle. Also disclosed are baffles and suppressors formed using these methods.

17 Claims, 3 Drawing Sheets

(56) References Cited

U.S. PATENT DOCUMENTS 8,286,750 B1* 10/2012 Oliver ..... F41A 21/30 181/223
8,875,612 B1* 11/2014 Klett ..... F41A 21/30 89/14.4
2004/0251140 A1* 12/2004 Chung ..... C25D 3/42 205/50
2005/0084407 A1* 4/2005 Myrick ..... B22F 1/0003 419/66
2007/0107590 A1* 5/2007 Silvers ..... F41A 21/30 89/14.4
2010/0304083 A1* 12/2010 Naritomi ..... C23F 1/26 428/141
2012/0065739 A1* 3/2012 Grohowski, Jr. ... A61F 2/30767 623/23.53
2012/0152093 A1* 6/2012 Koumbis ..... F41A 21/30 89/14.4
2012/0305825 A1* 12/2012 Mori ..... C22C 14/00 251/368
2013/0001086 A1* 1/2013 Yamashita ..... C01G 23/047 205/50
2014/0271337 A1* 9/2014 Banik ..... B21J 1/06 420/448
2014/0377119 A1* 12/2014 Abkowitz ..... C22C 14/00 419/23
2016/0107235 A1* 4/2016 Wilkinson ..... B22F 3/04 419/23
2016/0138423 A1* 5/2016 Ottow ..... B22F 5/009 415/200
2016/0161203 A1* 6/2016 Wilson ..... F41A 21/30 89/14.3
2016/0332236 A1* 11/2016 Stoyanov ..... B23B 27/14
2017/0008125 A1* 1/2017 Bruck ..... G01K 1/08

OTHER PUBLICATIONS

International search report dated Aug. 7, 2017 and International Preliminary Report on Patentability dated Jun. 12, 2018.

* cited by examiner

BAFFLES, SUPPRESSORS, AND POWDER FORMING METHODS

CROSS-REFERENCE TO RELATED APPLICATIONS

The present application claims benefit of U.S. Provisional Patent Application Ser. No. 62/264,225, filed Dec. 7, 2015, and entitled "SUPPRESSOR AND POWDER FORMING METHODS FOR MANUFACTURING," the disclosure of which is hereby incorporated by reference herein.

BACKGROUND OF THE INVENTION

Suppressors or silencers (referred to herein as "suppressors") are used to reduce the amount of noise and/or muzzle flash emitted from a firearm upon firing. Typically, suppressors are constructed with an array or stack of cone shaped thin-walled baffles. This assembly creates a complicated pathway designed to redirect and slow explosive gases escaping from the barrel of the firearm while the projectile travels through freely.

Because the suppressor baffles are stacked together they generally require high precision with respect to their mating surfaces. Further, they need to be constructed of material that can withstand the heat and pressure that they are exposed to during use. Materials of construction of conventional baffles are stainless steel, nickel base alloys, and titanium.

Conventional forming routes for suppressor baffles include (i) machining or (ii) casting followed by machining.

BRIEF SUMMARY OF THE INVENTION

Although well received, both methods have disadvantages from a materials cost perspective. Because the geometry of the baffle portion is a thin-walled cone, a substantial amount of material must be removed to form the baffle shape via machining. In fact, when machining a baffle, the material removal can be over 90%. This adds time and cost to the forming process.

Casting a near-net article and then machining it is more efficient than machining alone, but still has an inefficient use of material when the material wasted in the central sprue and the feed sprues is considered. Further, casting often introduces voids into the material that can cause problems in subsequent operations such as machining or welding. Powder metallurgy manufacturing methods, including powder compaction and powder metal injection molding (referred to collectively as "powder forming"), can provide improvements.

At a high level the powder forming approaches allow one to adjust an alloy's chemistry by adding constituents during powder system preparation to improve specific performance characteristics depending on the application. In the case of baffles, high ductility (low interstitials, e.g. low oxygen) could be traded for increased strength, increased high temperature strength, or increased creep resistance by adding oxygen or silicon.

The present invention contemplates the manipulation of powder constituents to improve high temperature behavior, whereas conventional testing of alloys has been focused on room temperature behavior. Indeed, strengthening an alloy at room temperature does not mean that the alloy will necessarily be stronger at high temperatures. This will be dependent upon the strengthening mechanism. For example, alloys subjected to a conventional solution-treat-age cycle will have an improved microstructure (and improved mechanical performance) at room temperature, but heating the material will alter the microstructure and diminish the high temperature properties. The present invention's approach is to instead alter the alloy chemistry at very low levels, to improve high temperature performance. Once oxygen and/or silicon or another material is added to the chemistry, the additive will remain, within reason, within the chemistry regardless of temperature. These elements strengthen the material by interstitial or substitutional means rather than alpha/beta phase content or phase morphology based microstructural mechanisms.

Further mechanisms such as oxide dispersion strengthening can continue to provide strengthening mechanisms at elevated temperatures.

In addition to the challenges of lowering cost and improving high temperature strength an additional challenge is wear of the bore. After repeated firing the hot gas and debris from the firearm propellant can erode the edges of the bore. The bore is typically very precise and the clearance between the bore and the projectile is critical to the performance of the suppressor. Improving the wear resistance of a baffle material can extend the useful lifetime of the suppressor.

Aspects of Group 1:

In accordance with one embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and approximately 0.3 weight percent.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and the firearm suppressor baffle has an elevated silicon content of between 0.1 to 0.6 weight percent.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and approximately 0.3 weight percent. The firearm suppressor baffle also having an elevated silicon content of between 0.1 to 0.3 weight percent.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and the sintered material has a creep value of less than 8% at 50 hours at 450 C.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and the sintered material has a creep value of less than 1.5% at 50 hours at 450 C.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and the firearm suppressor baffle has an elevated silicon content of between 0.1 to 0.6 weight percent, the sintered material having a creep value of less than 1.5% at 50 hours at 450 C.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and preparing the powder system includes blending of metal powder with at least one of titanium oxide, aluminum oxide powder, and silicon.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent and forming is through one of compaction and injection molding.

In accordance with a further embodiment of the present invention, there is provided a method of forming a firearm suppressor baffle, the method comprising preparing a titanium alloy powder system, forming of the powder system into a green shape, optionally green machining the green shape, and sintering the green shape to create a firearm suppressor baffle formed from sintered material; where the firearm suppressor baffle has an elevated oxygen content of between 0.2 and 0.5 weight percent, the method further comprising hot isostatic pressing of the firearm suppressor baffle.

In accordance with other embodiments of the present invention, a firearm suppressor baffle is formed by any of the preceding methods of Group 1.

In still further embodiments of the present invention, any of the preceding methods of Group 1 is used to form a plurality of firearm suppressor baffles, where each firearm suppressor baffle is used in a suppressor.

Aspects of Group 2:

In accordance with additional embodiments of the present invention, a method of forming a titanium alloy material comprises preparing a titanium alloy powder system, forming the titanium alloy powder system into a green shape through one of compaction and powder metal injection molding, sintering the green shape to create the titanium alloy material, the titanium alloy material having an oxygen content of greater than 0.2 weight percent and a creep value of less than 2% at 50 hours at 450 C.

In accordance with additional embodiments of the present invention, a method of forming a titanium alloy material comprises preparing a titanium alloy powder system, forming the titanium alloy powder system into a green shape through one of compaction and powder metal injection molding, sintering the green shape to create the titanium alloy material, the titanium alloy material having an oxygen content of greater than 0.2 weight percent and a creep value of less than 2% at 50 hours at 450 C, further comprising hot isostatic pressing of the titanium alloy material.

In accordance with other embodiments of the present invention, a firearm suppressor baffle is formed by either of the preceding methods of Group 2.

In still further embodiments of the present invention, either of the preceding methods of Group 2 is used to form a plurality of firearm suppressor baffles, where each firearm suppressor baffle is used in a suppressor.

Aspects of Group 3:

In accordance with a further embodiment of the present invention, a method of forming a firearm suppressor baffle comprises preparing a titanium aluminide powder system, forming the titanium aluminide powder system into a green shape through one of compaction and powder metal injection molding, sintering the green shape to create the firearm suppressor baffle.

In accordance with a further embodiment of the present invention, a method of forming a firearm suppressor baffle comprises preparing a titanium aluminide powder system, forming the titanium aluminide powder system into a green shape through one of compaction and powder metal injection molding, sintering the green shape to create the firearm suppressor baffle, and deoxygenating the firearm suppressor baffle.

In accordance with a further embodiment of the present invention, a method of forming a firearm suppressor baffle comprises preparing a titanium aluminide powder system, forming the titanium aluminide powder system into a green shape through one of compaction and powder metal injection molding, sintering the green shape to create the firearm suppressor baffle, where oxygen content of the firearm suppressor baffle is below 600 weight ppm. This method may also include deoxygenating the firearm suppressor baffle.

In accordance with a further embodiment of the present invention, a method of forming a firearm suppressor baffle comprises preparing a titanium aluminide powder system, forming the titanium aluminide powder system into a green shape through one of compaction and powder metal injection molding, sintering the green shape to create the firearm suppressor baffle, where oxygen content of the firearm suppressor baffle is below 200 weight ppm. This method may also include deoxygenating the firearm suppressor baffle.

In accordance with other embodiments of the present invention, a firearm suppressor baffle is formed by any of the preceding methods of Group 3.

In still further embodiments of the present invention, any of the preceding methods of Group 3 is used to form a plurality of firearm suppressor baffles, where each firearm suppressor baffle is used in a suppressor.

Aspects of Group 4:

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product.

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, where oxygen content of the titanium aluminide product is below 600 weight ppm.

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, where oxygen content of the titanium aluminide product is below 200 weight ppm.

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, where deoxygenating is by deoxidation in solid state (DOSS).

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, where deoxygenating is by molten salt electrolytic methods.

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, where forming is through one of compaction and powder metal injection molding.

In accordance with an additional embodiment of the present invention, a method of forming a titanium aluminide product comprises preparing a titanium aluminide powder system, forming the titanium aluminide powder system into a green shape, sintering the green shape to create a sintered product, deoxygenating the sintered product to form the titanium aluminide product, further comprising machining, including green machine.

In accordance with other embodiments of the present invention, a firearm suppressor baffle is formed by any of the preceding methods of Group 4.

In still further embodiments of the present invention, any of the preceding methods of Group 4 is used to form a plurality of firearm suppressor baffles, where each firearm suppressor baffle is used in a suppressor.

In accordance with a further embodiment of the present invention, there is provided a method of forming a suppressor baffle, the method including the step of powder forming the baffle with titanium powder, alloys thereof, or intermetallic powder. In the case of intermetallic powder, the powder may be gamma titanium aluminide. The method of powder forming any of the noted materials may also include cold isostatic pressing followed by green machining, sintering, and final machining. Using this method, the resultant baffle may be manufactured to approximately 98% dense. If slightly increased fatigue strength is required, the baffle may subsequently be hot isostatically pressed. Additionally, in the case of intermetallic powders such as titanium aluminide, a post sintering deoxygenating process may be utilized. Baffles formed in this manner may be stacked within a suppressor.

A further embodiment of this invention is a suppressor constructed with baffles formed from titanium aluminide, most preferably gamma titanium aluminide. In other embodiments, the suppressor may be constructed from titanium powder, alloys thereof, or stainless steel.

BRIEF DESCRIPTION OF THE DRAWINGS

The subject matter regarded as the invention is particularly pointed out and distinctly claimed in the concluding portion of the specification. The invention, however, both as to organization and method of operation, together with features, objects, and advantages thereof, will be or become apparent to one with skill in the art upon reference to the following detailed description when read with the accompanying drawings. It is intended that any additional organizations, methods of operation, features, objects or advantages ascertained by one skilled in the art be included within this description, be within the scope of the present invention, and be protected by the accompanying claims.

With respect to the drawings.

DETAILED DESCRIPTION

Figure 1:
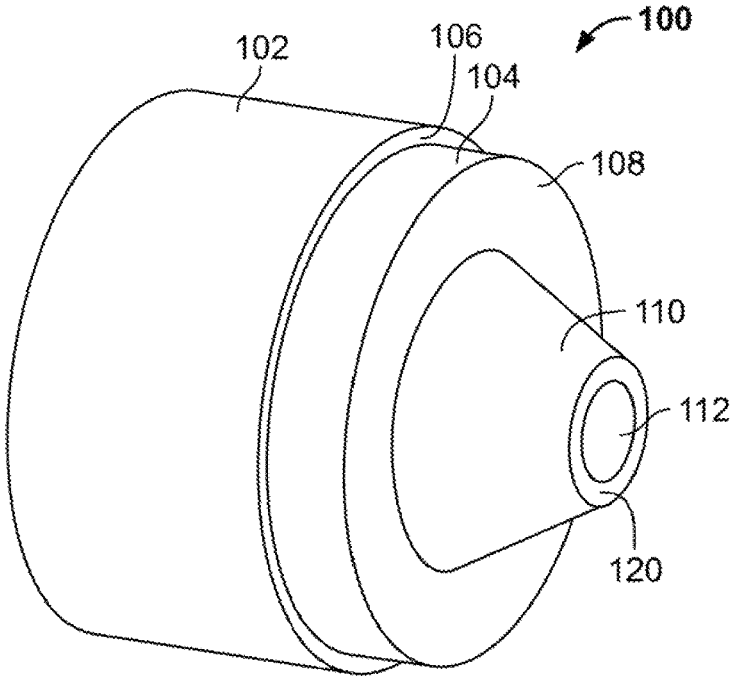
FIG. 1 shows a rear isometric view of a baffle in accordance with one embodiment of the present invention.

In the following are described the preferred embodiments of the BAFFLES, SUPPRESSORS, AND POWDER FORMING METHODS in accordance with the present invention. In describing the embodiments illustrated in the drawings, specific terminology will be used for the sake of clarity. However, the invention is not intended to be limited to the specific terms so selected, and it is to be understood that each specific term includes all technical equivalents that operate in a similar manner to accomplish a similar purpose.

Where like elements have been depicted in multiple embodiments, identical reference numerals have been used in the multiple embodiments for ease of understanding.

Rather than utilizing the conventional methods of (i) machining or (ii) casting followed by machining, it has been found that powder forming presents efficient routes for manufacturing thin-walled cone geometries such as suppressor baffles. These net-shape or near net-shape forming routes can substantially reduce the material wasted during the forming process without detriment to the finished product as compared to the two conventional techniques. The materials can also be formed with heretofore unseen performance characteristics, particularly at elevated temperatures.

It will be appreciated that one of the existing challenges for manufacturing suppressor baffles is the lack of materials that are both lightweight and capable of resisting the harsh environment created by repeated weapon firing. Titanium alloys, titanium aluminides, and stainless steel offer both high temperature performance and oxidation resistance. Using powder forming approaches to form these articles allows exacting control over the specific metallurgy and superior control over the microstructure.

For example, and particularly with titanium aluminides, use of a powder forming route eliminates the opportunity to form macro pores during the casting process. Because titanium aluminides are especially brittle, macro pores are detrimental. Indeed, macro pores can be eliminated completely using a powder forming route.

Further in the case of powder metallurgy, melting of the material is eliminated, permitting better control over the final microstructure by eliminating macro-segregation and providing for a more refined microstructure. Depending on the specific geometry it may be advantageous to use compaction forming methods, or for smaller or more complex geometries, powder metal injection molding methods.

Under the teachings herein, manufactured parts can be formed in a net-shape process or in a near net-shape process. Broadly, a net-shape process can entail a metal injection molding operation and hard tooling to form the part in a net-shape fashion. Molded articles may then be sintered to densify the article. If the required precision is outside of the process capability, the article may be machined after sintering.

A near net-shape process can entail a cold isostatic press and a combination of hard and soft tooling, or a die compaction process with hard tooling. The resulting preform may have some portions that are well defined by the hard portion of the tooling and some portions that are less well defined. This green article can be further formed in the green state via machining. After green forming, the article can be sintered to high density, and possibly hot isostatically pressed when 100% density is required, or at least greater than 98% density.

The powder materials used may include a pre-alloyed approach or a blended elemental approach. A powder metallurgy or powder forming approach allows the economical forming of materials that are expensive to cast, particularly titanium or intermetallics, such as gamma titanium aluminide.

Performance additives may also be provided with the powder preparation step. Oxygen can be added by blending in titanium oxide or aluminum oxide powder (in the case of Ti-6Al-4V). Silicon can be added by blending in fine silicon powder. Alternatively, the additional constituents can be specified to be present in the titanium powder.

Titanium powder is available in a wide range of oxygen contents. Commercially available titanium powder can range from 0.08 weight percent oxygen to over 0.7 weight percent oxygen, oxygen content is dependent upon the particle size distribution, the process used to manufacture the powder and the care used by the manufacturer of the powder. However, commercially available powders over 0.2 weight percent are not used for high performance applications and are reserved for cosmetic, pyrotechnic, or gettering. Custom alloys with other materials in them (such as increased silicon) could also be made or specified. It has been found, however, that the most practical technique is to blend in those performance additives at the powder preparation stage. In one example, titanium powder with 0.3 weight percent oxygen is utilized.

The preferred method of producing finished thin-walled parts such as suppressor baffles is the near net-shape process using cold isostatic pressing followed by green machining, sintering, and final machining. Using this route, baffles can be manufactured to about 98% dense, and in most case this will provide adequate strength for the finished product. If increased fatigue strength is required, the baffles may subsequently be hot isostatically pressed.

After pressing the green part can be green machined prior to sintering. This allows the removal of any excess material as well as the addition of details that are challenging or impossible to form during pressing.

At a high level the powder metal forming process, including aspects of both conventional powder metallurgy and powder metal injection molding, has steps that can include the following:

Powder system preparation: The powder may be blended with alloying components, sintering aids, pressing lubricants or binders, etc. In this stage performance enhancing additives may also be provided; for example, oxygen or silicon.

Compaction/forming: The powder system is formed into a green shape. This forming may be performed by a compaction method such as die compaction or cold isostatic pressing, or a binder assisted forming process such as powder metal injection molding.

Green machine: A green machining process may be used to add additional feature to the green article or to remove excess material.

Sintering: Green articles are thermally processed to sinter the powder and create a sintered product.

Deoxidizing: In the case of titanium aluminides, the sintered product may be deoxidized in a deoxidizing process, such as deoxidation in solid state (DOSS), molten salt electrolytic methods, or other deoxidation or reduction processes. Deoxidation may be performed before or after machining.

Final machining and finishing: Sintered parts (including deoxidized sintered parts) can be machined to add features or create more precise dimensions. Secondary operations such as hot isostatic pressing, polishing, or deburring may also be performed.

In the case of baffles, the powder forming route offered can reduce manufacturing costs while increasing performance. Baffles are subjected to high temperatures and pressure due to the expansion of hot gas out of the firearm and into the suppressor. It is at these high temperature and pressures where performance is demanded. The two performance standards tested were high temperature tensile strength and high temperature creep.

Titanium Alloy Considerations

The creep resistance of titanium baffles can be improved by using powder forming methods to create a baffle with enhanced high temperature creep performance beyond that of those formed from conventional means. In preferred embodiments, high temperature creep performance is enhanced by elevating oxygen levels to between 0.2 and 0.5 weight percent and optionally silicon to between 0.02 and 0.6 weight percent. In other embodiments, silicon levels may be elevated without oxygen being elevated.

Table 1 compares the elevated temperature tensile strength and creep resistance for several materials at 450 C. All samples were tested using ASTM E139-11: Standard Test Methods for Conducting Creep, Creep-Rupture, and Stress-Rupture Tests of Metallic Materials and ASTM E21-09: Standard Test Methods for Elevated Temperature Tension Tests of Metallic Materials. Sample 1 was prepared from commercially available titanium round stock and Samples 2-4 were prepared via powder forming methods, which allowed the alloy components to be manipulated.

By elevating the oxygen level of the TI-6Al-4V alloy to 0.3 weight percent (from 0.13 weight percent), a substantial increase in creep strength is observed over the conventional material of Sample 1. While Sample 1 showed substantially higher tensile strength values for both ultimate and yield tensile strengths, it had a substantially lower creep resistance. This is initially counter-intuitive, yet it serves to demonstrate that tensile strength performance does not necessarily indicate improved creep resistance. For certain manufactured parts, such as firearm suppressor baffles, creep resistance quality can outweigh yield strength.

Sample 1 has a wrought microstructure resulting in higher initial strengths, however the microstructural advantages are not stable over time at elevated temperature. By increasing the oxygen content to 0.3 weight percent, the creep performance of the Ti-6Al-4V titanium is increase by more than an order of magnitude. Further improvements in creep and tensile strength are seen with additions of silicon to the alloy in Samples 3 and 4. It is worth noting that the improvement of Samples 3 and 4 over Sample 2 do not come at any appreciable cost to the elongation values.

TABLE 1

Tensile strength and creep performance of Ti—6Al—4V materials at 450 C.

| Sample | Condition | Oxygen (wt %) | Silicon (wt %) | Ultimate Tensile Strength (ksi) | Yield Tensile Strength (ksi) | Elongation (%) | Creep (%) (450 C./58 ksi) (50 h) |
|---|---|---|---|---|---|---|---|
| 1 | Wrought | 0.13 | — | 97.8 | 82.6 | 24.0 | 9.33 |
| 2 | Beta-annealed | 0.30 | — | 80.8 | 63.5 | 15.5 | 0.88 |
| 3 | Beta-annealed | 0.30 | 0.09 | 83.9 | 71.1 | 15.5 | 0.52 |
| 4 | Beta-annealed | 0.30 | 0.3 | 89.4 | 73.6 | 17.0 | 0.27 |

While the relationship of oxygen content to tensile strength at room temperature is well understood, tensile strength at room temperatures is not necessarily indicative of high temperature strength or creep resistance. Other observations serve to demonstrate how this is not intuitively scalable. Table 2 compares the performance of two powder metal processed alloys, both of which have an oxygen level of 0.3 weight percent. Both materials were formed from powders and beta annealed and demonstrate how different strengthening mechanisms have outsized effects at elevated temperatures. While Ti-6Al-4V and Ti-6Al-2Sn-4Zr-2Mo material have similar tensile strengths at elevated temperature, these properties depart substantially with respect to creep. There is about a 1.1× increase in high temperature tensile strength between the two alloys, but almost a 15× increase in creep resistance.

TABLE 2

Comparison of elevated temperature performance of PM Ti Alloy materials

| Powder Metal Alloy | Oxygen (wt %) | Ultimate Tensile Strength (ksi) (450 C.) | Creep (%) (450 C./58 ksi) (50 hr) |
|---|---|---|---|
| Ti—6Al—4V | 0.3 | 80.8 | 0.88 |
| Ti—6Al—2Sn—4Zr—2Mo | 0.3 | 89.1 | 0.06 |

To improve wear properties of the finished article hard particles can be included in the alloy. Titanium carbide can be added at levels between 0.5 and 35 weight percent to improve both wear and creep resistance.

Previously developed alloys having improved temperature resistance can also be employed or modified. Ti-6Al-2Sn-4Zr-2Mo-0.08Si is a known alloy. In an embodiment, a baffle is made of Ti-6Al-2Sn-4Zr-2Mo-0.3O-0.08Si by powder methods. In another embodiment, this alloy is formulated as a metal matrix composite, with 15 weight percent titanium carbide.

Similar improvements can be made to other high performance materials such as nickel base super-alloys.

Stainless Steel Considerations

Stainless steel can also be used to fabricate parts such as suppressor baffles. In this respect 17-4 ph is a preferred material because of its high tensile strength. The powder forming route allows for the incorporation of strengthening mechanisms to stainless alloys. The desired alloy can be fabricated by atomization, mechanical alloying, a powder blending approach or other method of creating a dispersed oxide system. There are many other additions that can be used to improve creep and temperature resistance, among them carbon or molybdenum.

There are several challenges to manufacturing stainless steel baffles via powder forming. The application is price sensitive and consequently raw material cost is a consideration. Coarse powder is less expensive than fine powder so it is a preferable raw material. A challenge of processing coarse stainless steel via powder forming methods is that the coarse particles do not sinter as easily as fine powders. To achieve comparative tensile strength competitive with conventional stainless steel, powder formed stainless steel requires high sintered densities, preferably 98% dense or greater.

Corrosion resistance is also an issue when sintering stainless steel. To achieve appropriate corrosion resistance the powder should be sintered well above closed porosity, preferably 98% or greater.

Another challenge is that stainless steel does not have the favorable high temperature performance of nickel based super-alloys and does not offer substantial weigh reduction when compared to nickel based alloys. It is desirable to improve the high temperature performance of stainless baffles.

It has been found that by optimizing the stainless alloy chemistry via powder metallurgy, one may provide for adequate tensile strength and corrosion resistance while increasing the high temperature performance. It has also been found possible to use coarse stainless powder (powder having a d90 of 75 microns or greater) to form baffles sintered to near full or full density.

By adding silicon to the stainless chemistry, sintering can be aided by forming a liquid phase and high temperature performance can be improved. Typically, sintering improvement can be made between 1 and 6 weight percent silicon. Typically, high temperature properties can be improved by adding 0.2 to 3.0 weight percent.

The addition of silicon to a 17-4 stainless steel powder system can significantly improve its sintering. Pre-alloyed 17-4 ph stainless steel powder having a d90 of 75 microns that is isostatically pressed and then sintered could not achieve a density of about 95.5 percent. However, the addition of 3% silicon allowed the material to sinter to over 99.5 percent dense.

There are multiple alloying routes that can be used to improve the high temperature performance of stainless steels. Further or additional benefits can be made by the addition of molybdenum carbon or other elements depending on the specific alloy chemistry. Carbon contents vary between 0.1 and 1.0 weight percent. It is also possible to increase the chromium content and potentially the nickel content; or incorporate nitrogen, silicon, or rare earth metals into the alloy.

Stainless powders can be die compacted or cold isostatically pressed. Lubricant can be added to improve the compaction behavior and binders can also be added to further improve the green strength and green machinability of the compact. Binder content can range in between 0 and 5 weight percent.

Titanium Aluminide Considerations

With respect to titanium aluminide, additional challenges exist to processing this material via a powder route. These challenges are based in the material's sensitivity to contamination such as carbon or oxygen and the limited availability of low contamination powder. While there are analogs of this problem present in titanium powder processing, it is severely aggravated in the realm of titanium aluminide. Specifications may limit oxygen content to below 600 weight ppm, which is very challenging to obtain in a commercial powder product let alone maintain in a sintered compact made from fine titanium aluminide powder.

By incorporating a deoxidizing process after sintering, these challenges can be overcome. Deoxygenation processes for titanium are typically not practical because they add cost, and more importantly it is difficult to control what the final oxygen content will be. In typical titanium alloy, there is an oxygen range over which optimal properties are achieved, below the lower limit of this range the titanium materials will exhibit decreased tensile strength and above the upper limit of this range the material will become embrittled. Because of their differences in atomic structure when compared to metal alloys, titanium aluminide and other intermetallics are more sensitive to high interstitial contamination, but not dependent on it to improve their properties at low level. Thus, the ability to control the exact level of oxygen remaining after deoxygenation is not as critical to final properties provided a level below a certain maximum oxygen level is obtained. Consequently, deoxygenation processes that would be considered impractical for titanium alloys can be employed with titanium aluminides to produce higher performance materials more effectively. These processes include deoxidation in solid state (DOSS), molten salt electrolytic methods, or other known deoxidation or reduction processes. Moreover, it has been found that oxygen levels can be driven below 200 parts per million without considerable detrimental effects.

Figure 2:
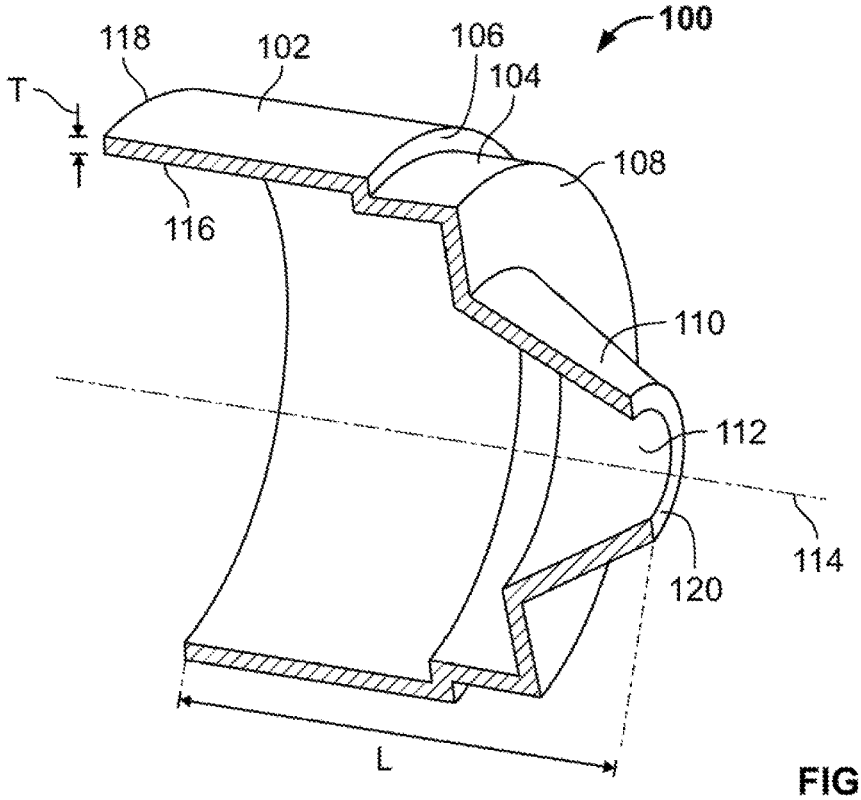
FIG. 2 shows an isometric cross-sectional view of the baffle of FIG. 1.

Baffle configurations formed by these powder forming processes may differ considerably. Nevertheless, FIG. 1 shows a rear isometric view of a baffle 100 in accordance with one embodiment of the present invention. FIG. 2 shows an isometric cross-sectional view of the baffle of FIG. 1. Viewed together, it will be appreciated that the baffle 100 is generally cylindrical with a conical taper. Indeed, the baffle 100 includes a major cylindrical section 102 with a minor cylindrical section 104 extending therefrom to create a first shoulder 106. A second shoulder 108 is formed where the minor cylindrical section 104 meets the largest diameter of a conical section 110. The overall length L of baffle 100 is 60 mm but can be altered per design considerations.

It will be further appreciated that the baffle 100 is hollow, forming a bore 112 through its centerline 114. Bore 112, and particularly the interior surface 116 thereof, follows the geometry of the major cylindrical section 102, first shoulder 106, minor cylindrical section 104, second shoulder 108, and finally the conical section 110. Being "thin-walled," the baffle has a thickness "T" which is orders of magnitude thinner than length L, for example 1.5 mm. This thickness is best observed at first end 118 or second end 120.

Figure 3:
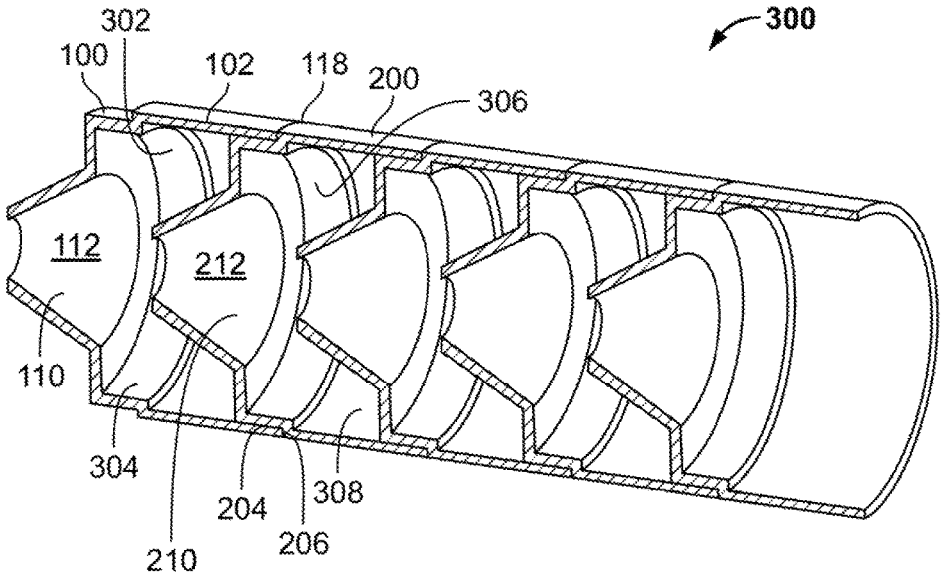
FIG. 3 shows an isometric cross-sectional view of a plurality of baffles as shown in FIG. 1 stacked in tandem in an assembled relation.

FIG. 3 shows an isometric cross-sectional view of a baffle assembly 300, consisting of a plurality of baffles as shown in FIG. 1 stacked in tandem. To configure such an assembly 300, baffles, for example baffles 100 and 200, are oriented in the same "direction", here with their conical sections 110, 210 facing toward the viewer's left. The baffles 100, 200 are then brought into contact with each other such that the first end 118 of baffle 100 abuts the exterior of first shoulder 206 of baffle 200. Portions of the bore 112 of baffle 100, particularly a section of major cylindrical section 102, frictionally engages the exterior of minor cylindrical section 204 of baffle 200. Additional baffles can then be added to the assembly 300 as shown in FIG. 3.

In the orientation of assembly 300 shown in FIG. 3, it will be appreciated that a projectile (not shown) fired from a firearm (not shown) will travel from the viewer's left to right, straight through bores 112, 212. Gasses expelled from the firearm with the projectile will expand into cavities 302, 304, 306, 308, etc. upon firing. It is these cavities 302, 304, 306, 308, etc. which aid in dissipating energy from the blast to suppress sound and flash from the firearm.

Figure 4:
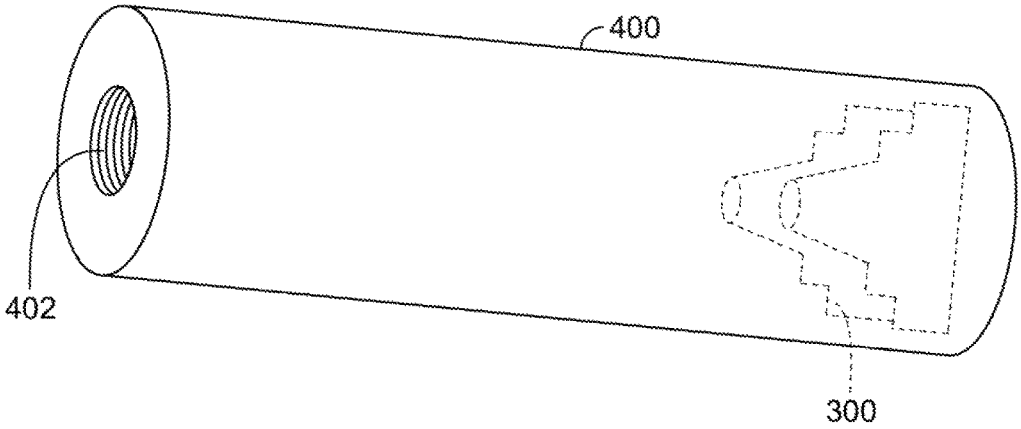
FIG. 4 depicts a perspective view of a baffle assembly within a suppressor tube.

The assembly 300 of FIG. 3 may itself form a suppressor, for example where the baffles 100, 200, 300 are welded together. Alternatively, baffle assemblies may be fitted within a suppressor tube 400 as shown in FIG. 4. Suppressor tubes, such as suppressor tube 400, are typically cylindrical and include threaded connections 402 for threading onto the barrel of a firearm as well as an end cap (not shown) for retaining the baffles in the assembly.

Figure 5A:
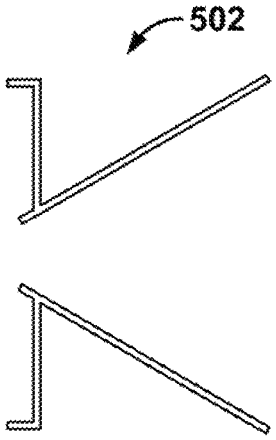
FIGS. 5A, 5B, and 5C depict non-limiting examples of alternate baffle configurations.
Figure 5B:
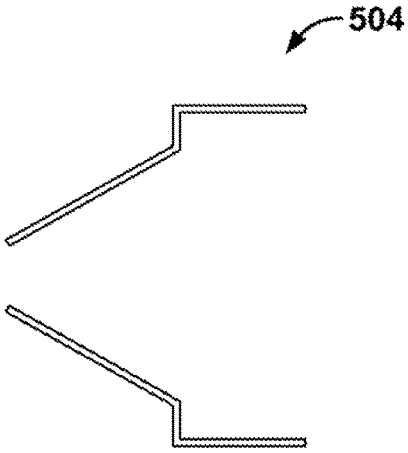
Figure 5C:
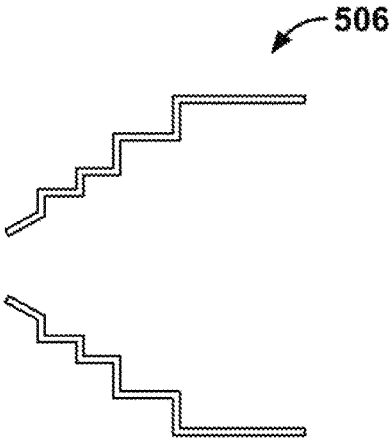

Other baffle types, all of which may be produced using the techniques taught herein, are shown in FIGS. 5A, 5B, and 5C. These include the K baffle 502, conical baffle 504, and step cone baffle 506. Additional baffle configurations may also be provided.

Although not shown, the baffles may include additional features to aid in dissipation of this energy. For example, apertures may be formed in baffle, for example in the conical section or the second shoulder. Various holes ports and vents and other elements can be added to direct, divert and manipulate the gas flow.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

We claim:

1. A method of forming a firearm suppressor baffle, the method comprising:

preparing a titanium alloy powder system;

forming of the powder system into a green shape;

optionally green machining the green shape;

sintering the green shape to create a firearm suppressor baffle formed from sintered material, the sintered material having a creep value of less than 1.5% at 50 hours at 450 C;

wherein, the firearm suppressor baffle has an elevated oxygen content of between 0.2 and 0.5 weight percent.

2. The method of claim 1, wherein the elevated oxygen content is approximately 0.3 weight percent.

3. The method of claim 2, wherein the firearm suppressor baffle has an elevated silicon content of between 0.1 to 0.3 weight percent.

4. The method of claim 1, wherein the firearm suppressor baffle has an elevated silicon content of between 0.1 to 0.6 weight percent.

5. The method of claim 4, wherein the sintered material has a creep value of less than 0.9% at 50 hours at 450 C.

6. The method of claim 1, wherein the sintered material has a creep value of less than 0.9% at 50 hours at 450 C.

7. The method of claim 1, wherein preparing the powder system includes blending of metal powder with at least one of titanium oxide, aluminum oxide powder, and silicon.

8. The method of claim 1, wherein forming is through one of compaction and injection molding.

9. The method of claim 1, further comprising hot isostatic pre-sing of the firearm suppressor baffle.

10. The method of claim 1, wherein the firearm suppressor baffle comprises a Ti-6Al-2Sn-4Zr-2MO alloy.

11. The method of claim 10, wherein tie sintered material has a creep value of approximately 0.06% at 50 hours at 450 C.

12. The method of claim 1, wherein the firearm suppressor baffle comprises a Ti-6Al-4V alloy.

13. The method of claim 12, wherein the sintered material has a creep value of approximately 0.88% at 50 hours at 450 C.

14. The method of claim 1, wherein the firearm suppressor baffle consists of a Ti-6Al-2Sn-4Zr-2Mo alloy.

15. The method of claim 1, wherein the firearm suppressor baffle consists of a Ti-6Al-4V alloy.

16. A firearm suppressor baffle formed by the method, of claim 1, said firearm suppressor baffle having a creep value of less than 1.5% at 50 hours at 450 C and an elevated oxygen content of between 0.2 and 0.5 weight percent.

17. A firearm suppressor comprising a plurality of firearm suppressor baffles, each firearm suppressor baffle formed by the method of claim 1 and each firearm suppressor baffle having a creep value of less than 1.5% at 50 hours at 450 C and an elevated oxygen content of between 0.2 and 0.5 weight percent.

* * * * *